US008292410B2

(12) United States Patent
Yazaki et al.

(10) Patent No.: US 8,292,410 B2
(45) Date of Patent: Oct. 23, 2012

(54) LIQUID EJECTING HEAD, LIQUID EJECTING APPARATUS, AND ACTUATOR DEVICE

(75) Inventors: Shiro Yazaki, Chino (JP); Eiju Hirai, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 296 days.

(21) Appl. No.: 12/723,803

(22) Filed: Mar. 15, 2010

(65) Prior Publication Data

US 2010/0245491 A1 Sep. 30, 2010

(30) Foreign Application Priority Data

Mar. 26, 2009 (JP) ..... 2009-077844

(51) Int. Cl.
*B41J 2/045* (2006.01)

(52) U.S. Cl. ..... 347/71; 347/72; 347/68; 310/340; 310/311

(58) Field of Classification Search ..... 347/68–72; 310/340, 311; 29/25.35
See application file for complete search history.

(56) References Cited

U.S. PATENT DOCUMENTS

| | | | | |
|---|---|---|---|---|
| 5,984,459 | A | 11/1999 | Takahashi et al. | |
| 6,089,701 | A | 7/2000 | Hashizume et al. | |
| 2007/0091149 | A1 * | 4/2007 | Yazaki | 347/68 |
| 2007/0284967 | A1 * | 12/2007 | Shimada et al. | 310/328 |
| 2008/0239017 | A1 * | 10/2008 | Takabe et al. | 347/68 |

FOREIGN PATENT DOCUMENTS

| | | | |
|---|---|---|---|
| JP | 10-226071 | | 8/1998 |
| JP | 2005-212289 | | 8/2005 |
| JP | 2007-144998 | | 6/2007 |
| JP | 2007144998 A | * | 6/2007 |
| JP | 2007-175989 | | 7/2007 |
| JP | 2007-296864 | | 11/2007 |
| JP | 2008-114372 | | 5/2008 |

* cited by examiner

*Primary Examiner* — Matthew Luu
*Assistant Examiner* — Henok Legesse
(74) *Attorney, Agent, or Firm* — Workman Nydegger

(57) ABSTRACT

A liquid ejecting head includes a flow passage substrate having a pressure generation chamber in communication with a nozzle opening. A piezoelectric element includes first and second electrode and a piezoelectric substance layer and is positioned over one surface of the flow passage substrate. The piezoelectric element is deformed to form a convex toward the pressure generation chamber when the piezoelectric element is driven. A protection film formed from an inorganic material covers the piezoelectric element and has an opening through which an upper surface of the second electrode is exposed. An end of the opening in the protection film viewed in a direction of the length of the pressure generation chamber is located closer to the center than is an area at which the center of curvature of a curve of the piezoelectric element that forms near a wall around the pressure generation chamber during deformation operation.

4 Claims, 4 Drawing Sheets

LIQUID EJECTING HEAD, LIQUID EJECTING APPARATUS, AND ACTUATOR DEVICE

The entire disclosure of Japanese Patent Application No. 2009-77844, filed Mar. 26, 2009 is expressly incorporated herein by reference.

BACKGROUND

1. Technical Field

The present invention relates to a liquid ejecting head, a liquid ejecting apparatus, and an actuator device.

2. Related Art

A part of a pressure generation chamber of an ink-jet recording head is made of a vibrating diaphragm. The pressure generation chamber is in communication with a nozzle orifice through which ink is ejected. A piezoelectric element deforms the vibrating diaphragm to pressurize ink that is retained in the pressure generation chamber. The ink-jet recording head ejects the pressurized ink from the nozzle orifices. Some ink-jet recording heads use a deformation-vibration-mode actuator device as such a piezoelectric element.

For example, a deformation-vibration-mode actuator device has piezoelectric elements manufactured as follows. A uniform piezoelectric material layer is formed over the entire surface of a vibrating diaphragm by means of a film deposition method. Then, by means of a lithography method, the piezoelectric material layer is separated into a plurality of area portions each of which has a shape corresponding to that of a pressure generation chamber. As a result, an individual piezoelectric element is formed for each of the plurality of pressure generation chambers. Such a piezoelectric element is susceptible to adverse effects from external environment such as, for example, moisture or the like, which causes damage to the piezoelectric element.

To protect a piezoelectric element against damage without obstructing the deformation operation of the piezoelectric element, the following head structure has been proposed in the art as disclosed in, for example, Japanese Patent No. 3552013 (refer to Page 4 and FIG. 4). In the disclosed head structure, a thin insulating film covers a partial region from the peripheral part of a surface of a second electrode inclusive to the side surfaces of a piezoelectric substance layer inclusive. The second electrode and the piezoelectric substance layer are components of the piezoelectric element. The insulating film is made of silicon oxide, silicon nitride, an organic material, or preferably, photosensitive polyimide.

However, the head structure disclosed in the above patent document has a disadvantage in that stress concentrates near an end of an exposed area when a piezoelectric element deforms. For this reason, there is a risk that the piezoelectric element is damaged due to stress concentration, which is a problem that remains to be solved.

The problem explained above is not unique to an ink-jet recording head that ejects ink. That is, the same problem could occur in various kinds of other liquid ejecting heads that eject liquid other than ink.

SUMMARY

An advantage of some aspects of the invention is to provide a liquid ejecting head, a liquid ejecting apparatus, and an actuator device that make it possible to avoid stress concentration and thereby prevent piezoelectric elements from being damaged.

In order to address the above problems without any limitation thereto, a liquid ejecting head according to a first aspect of the invention includes a flow passage substrate that has a pressure generation chamber, the pressure generation chamber formed in the flow passage substrate being in communication with a nozzle opening through which liquid is ejected; a piezoelectric element that includes a first electrode, a piezoelectric substance layer, and a second electrode, the piezoelectric element being provided over one surface of the flow passage substrate, the piezoelectric element getting deformed to form a convex toward the pressure generation chamber when the piezoelectric element is driven; and a protection film that covers the piezoelectric element, the protection film having an opening through which an upper surface of the second electrode is exposed, the protection film being made of an inorganic insulating material, wherein an end of the opening formed in the protection film viewed in a direction of the length of the pressure generation chamber is located at a position relatively close to the center in comparison with an area at which the center of curvature of a curve of the piezoelectric element that forms near a wall around the pressure generation chamber during deformation operation lies at a pressure-generation-chamber side. In the structure of a liquid ejecting head according to the first aspect of the invention, an end of an opening formed in a protection film viewed in a direction of the length of a pressure generation chamber is located at a position relatively close to the center in comparison with an area at which the center of curvature of a curve of the piezoelectric element that forms near a wall around the pressure generation chamber during deformation operation lies at a pressure-generation-chamber side. In other words, the end of the opening is located relatively close to the center in comparison with the area at which stress acts on a piezoelectric substance layer at a protection-film side in a pulling direction. With such a structure, pulling stress does not act at the end of the opening of the protection film. For this reason, it is possible to avoid stress concentration and thereby prevent the piezoelectric element from being damaged.

In the structure of a liquid ejecting head according to the first aspect of the invention, it is preferable that the first electrode should be provided over the one surface of the flow passage substrate with a vibrating diaphragm being sandwiched between the first electrode and the flow passage substrate; an end of the first electrode viewed in the direction of the length of the pressure generation chamber should be located at a position relatively close to the center in comparison with an area at which the center of curvature of a curve of the vibrating diaphragm and the piezoelectric element that forms near the wall around the pressure generation chamber during deformation operation lies at the pressure-generation-chamber side; and the end of the opening formed in the protection film viewed in the direction of the length of the pressure generation chamber should be located over the first electrode. In the preferred structure, the end of the opening formed in the protection film viewed in the direction of the length of the pressure generation chamber is located at a position relatively close to the center over the first electrode in comparison with an area at which the center of curvature of a curve of the vibrating diaphragm and the piezoelectric element that forms near the wall around the pressure generation chamber during deformation operation lies at the pressure-generation-chamber side. In other words, the end of the opening is located relatively close to the center over the first electrode in comparison with the area at which stress acts on the piezoelectric substance layer at the protection-film side in the pulling direction. Accordingly, the end of the opening formed in the protection film viewed in the direction of the length of the pressure generation chamber is not located in the area where pulling stress acts. In addition, the end of the opening is located at an area that is less susceptible to stress over the first electrode. With such a preferred structure, it is possible to avoid stress concentration and thereby prevent the piezoelectric element from being damaged.

With patterning precision taken into consideration, it is preferable that a distance between the end of the opening formed in the protection film viewed in the direction of the length of the pressure generation chamber and the end of the first electrode viewed in the direction of the length of the pressure generation chamber is 10 μm or greater.

A liquid ejecting apparatus according to a second aspect of the invention is provided with a liquid ejecting head according to the first aspect of the invention, including preferred modes thereof. Since the liquid ejecting apparatus is provided with the liquid ejecting head described above, it is possible to prevent the piezoelectric element from being damaged.

An actuator device according to a third aspect of the invention includes a piezoelectric element that includes a first electrode, a piezoelectric substance layer, and a second electrode, the piezoelectric element being provided at an area facing a concave portion of a substrate, the piezoelectric element getting deformed to form a convex toward a pressure generation chamber when the piezoelectric element is driven; and a protection film that covers the piezoelectric element, the protection film having an opening through which a surface of the second electrode is exposed, the protection film being made of an inorganic insulating material, wherein an end of the opening formed in the protection film viewed in a direction of the length of the pressure generation chamber is located at a position relatively close to the center in comparison with an area at which the center of curvature of a curve of the piezoelectric element that forms near a wall around the pressure generation chamber during deformation operation lies at a pressure-generation-chamber side. In the structure of an actuator device according to the third aspect of the invention, an end of an opening formed in a protection film viewed in a direction of the length of a pressure generation chamber is located at a position relatively close to the center in comparison with an area at which stress acts on a piezoelectric substance layer at a protection-film side in a pulling direction. With such a structure, pulling stress does not act at the end of the opening of the protection film. For this reason, it is possible to avoid stress concentration and thereby prevent a piezoelectric element from being damaged.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, exemplary embodiments of the present invention will now be explained in detail.

First Embodiment

Figure 1:
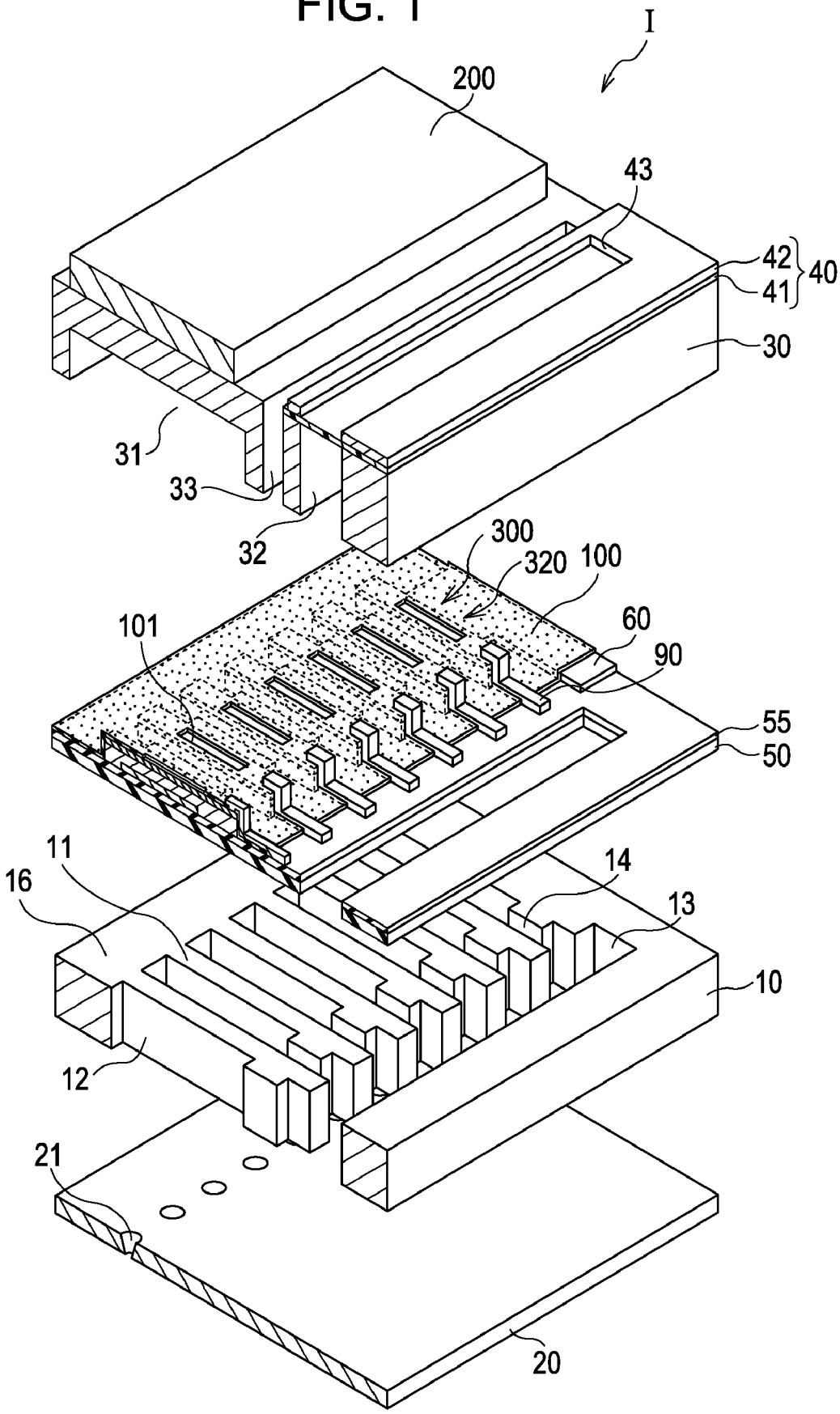
FIG. 1 is an exploded perspective view that schematically illustrates an example of the structure of a recording head according to an exemplary embodiment of the invention.
Figure 2A:
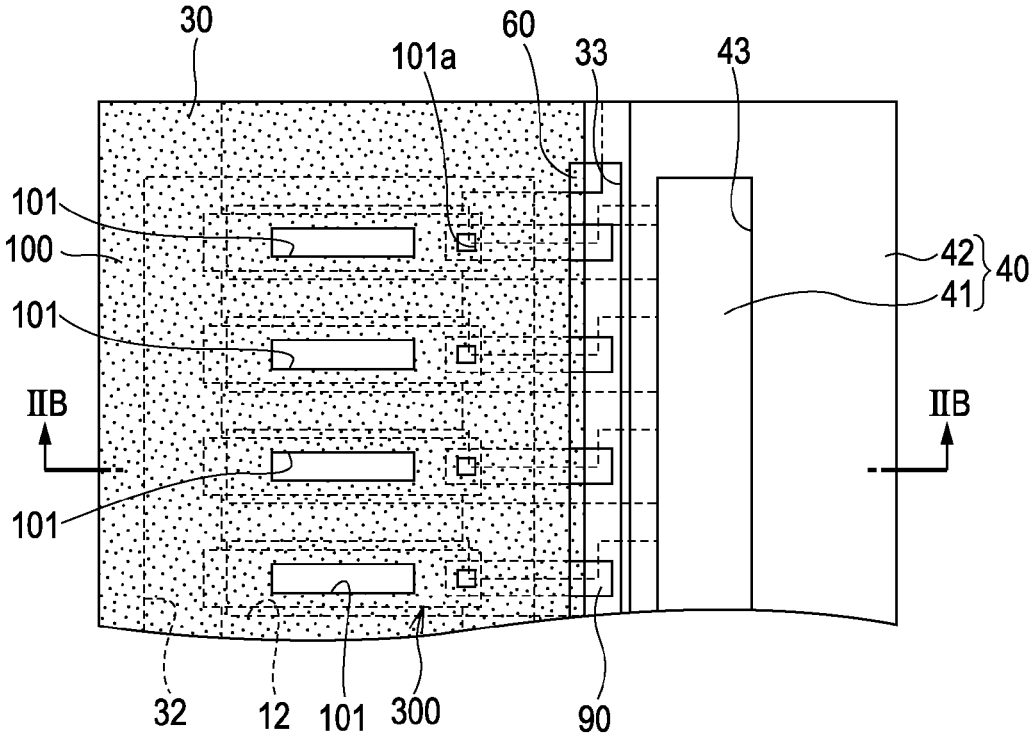
FIG. 2A is a plan view that schematically illustrates an example of an essential part of a recording head according to an exemplary embodiment of the invention.
Figure 2B:
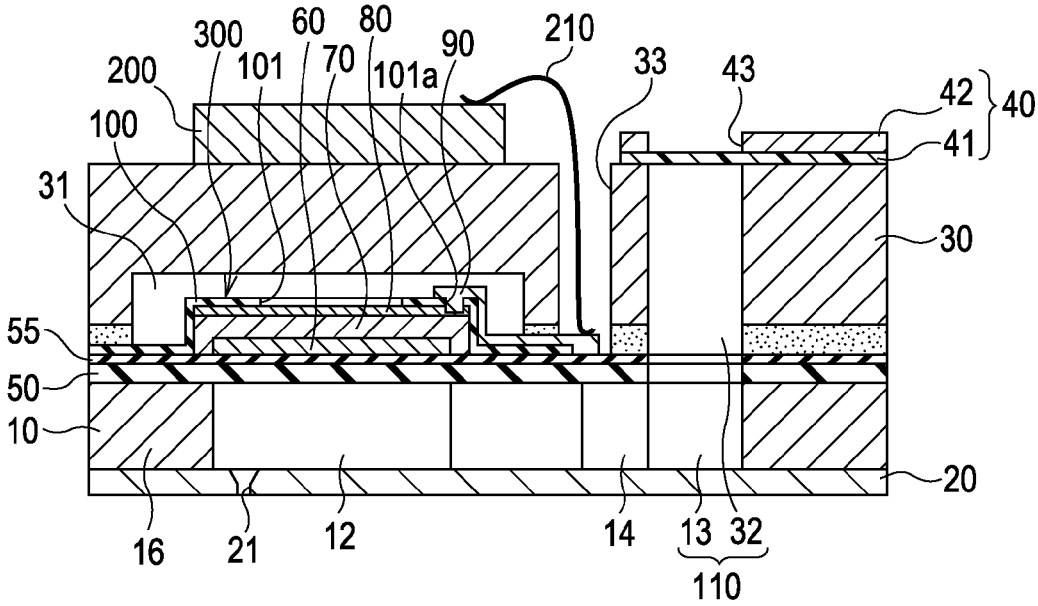
FIG. 2B is a sectional view taken along the line IIB-IIB of FIG. 2A.

FIG. 1 is an exploded perspective view that schematically illustrates an example of the structure of an ink-jet recording head according to an exemplary embodiment of the invention. FIG. 2A is a plan view that schematically illustrates an example of an essential part of the ink-jet recording head. FIG. 2B is a sectional view taken along the line IIB-IIB of FIG. 2A. A fluid channel formation substrate 10 of an ink-jet recording head I is a silicon single crystal substrate. As illustrated in these drawings, an elastic membrane 50, which is made of silicon dioxide, is pre-formed on one surface of the fluid channel formation substrate 10 through thermal oxidation. The elastic membrane 50 has a thickness of 0.5 to 2.0 μm. The fluid channel formation substrate 10 has a plurality of pressure generation chambers 12. The pressure generation chambers 12 are compartments that are separated and demarcated by partition walls 11. The pressure generation chambers 12 are arrayed adjacent to one another in the direction of the width of the pressure generation chamber 12. A communicating portion 13 is formed at an area outside the lines of the pressure generation chambers 12 viewed in the longitudinal direction thereof. The communicating portion 13 is in communication with each of the plurality of pressure generation chambers 12 through an ink supply passage 14. The ink supply passage 14 is formed for each of the plurality of pressure generation chambers 12. The communicating portion 13 is in communication with a reservoir portion that is provided in a protection substrate that will be explained later. In communication with each other, the communicating portion 13 and the reservoir portion constitute a reservoir, which serves as a common ink chamber for each of the plurality of pressure generation chamber 12. The ink supply passage 14 has a width that is narrower than that of the pressure generation chamber 12. Having the narrower width, the ink supply passage 14 has a function of maintaining the fluid channel resistance of ink that flows into the pressure generation chamber 12 from the communicating portion 13 at a constant level.

A nozzle plate 20 is bonded to the opening-surface side of the fluid channel formation substrate 10 by means of an adhesive, a thermal deposition/adhesion film, or the like with a masking film being sandwiched therebetween. A plurality of nozzle orifices (i.e., nozzle holes) 21 is bored through the nozzle plate 20. The nozzle orifice 21 is communicated with one end region of each of the pressure generation chambers 12 opposite to the other end region thereof next to which the ink supply passage 14 is formed.

As explained above, the elastic membrane 50 that is made of silicon dioxide and has a thickness of, for example, approximately 1.0 μm is formed on the other surface of the fluid channel formation substrate 10 that is opposite to the opening surface thereof. An insulating film 55 that is made of zirconium oxide ($ZrO_2$) or the like is formed on the elastic membrane 50. Piezoelectric elements 300 are provided on the insulating film 55. The piezoelectric element 300 includes a first electrode 60, a piezoelectric substance layer 70, and a second electrode 80.

The piezoelectric element 300 is a layer part including the first electrode 60, the piezoelectric substance layer 70, and the second electrode 80. Generally, either one of the first electrode 60 and the second electrode 80 of the piezoelectric element 300 is configured as a common electrode, whereas the other thereof as well as the piezoelectric substance layer 70 is individually patterned for each of the pressure generation chambers 12. Piezoelectric distortion/deflection occurs at the time of application of a voltage to both electrodes at a portion that includes the patterned electrode and the piezoelectric substance layer 70, which is hereinafter referred to as "piezoelectric substance activation portion" 320. In the present embodiment of the invention, the first electrode 60 is configured as the common electrode of the piezoelectric elements 300, whereas the second electrode 80 is configured as individual electrodes thereof. However, the scope of the invention is not limited to such an exemplary structure. The first electrode 60 and the second electrode 80 may be reversed if it is required, or advantageous, because of circuit line patterning, driving circuit layout, or other reasons. Whichever structure is chosen, one piezoelectric substance activation portion 320 is formed for each of the pressure generation chambers 12.

In the present embodiment of the invention, each of two opposite ends of the first electrode 60 viewed in the length direction of the pressure generation chamber 12 is formed inside an area corresponding to the area of the pressure generation chamber 12, thereby determining the long-side ends (length) of the piezoelectric substance activation portion 320, which serves as an actual driving portion of the piezoelectric element 300. In addition, each of two opposite ends of the piezoelectric substance layer 70 and each of two opposite ends of the second electrode 80 viewed in the width direction of the pressure generation chamber 12 is formed inside an area corresponding to the area of the pressure generation chamber 12, thereby determining the short-side ends (width) of the piezoelectric substance activation portion 320. Since the first electrode 60 and the patterned second electrode 80 are formed as explained above, the piezoelectric substance activation portion 320 is formed at an area corresponding to the area of the pressure generation chamber 12 only.

The piezoelectric element 300 that gets deformed when driven is referred to as an actuator device. In the present embodiment of the invention, the first electrode 60 is formed as an electrode that extends throughout the plurality of piezoelectric elements 300 in the array direction thereof. In addition, the first electrode 60 is formed at an area where each of two opposite ends of the first electrode 60 viewed in the length direction of the pressure generation chamber 12 lies over the corresponding end of the pressure generation chamber 12. In the above example, a combination of the elastic membrane 50, the insulating film 55, and the first electrode 60 functions as a vibrating diaphragm that gets deformed together with the piezoelectric element 300. However, the scope of the invention is not limited to such an exemplary structure. For example, the first electrode 60 only may function as a vibrating diaphragm with the omission of the elastic membrane 50 and the insulating film 55.

A protection film 100 covers the first electrode 60, the piezoelectric substance layer 70, and the second electrode 80 (the piezoelectric substance activation portion 320) that make up the piezoelectric element 300. The protection film 100 is made of a moisture-resistant insulating material. Specifically, the protection film 100 covers the side surfaces of the piezoelectric substance layer 70 and the second electrode 80. In addition, the protection film 100 covers the peripheral part of the upper surface of the second electrode 80. That is, the protection film 100 is not formed on the non-peripheral part of upper surface of the second electrode 80. The protection film 100 has an opening area 101 through which the non-peripheral part of upper surface of the second electrode 80 is exposed. The opening 101 is formed through the protection film 100 in the thickness direction thereof. The opening 101 has a rectangular shape that is elongated in the length direction of the piezoelectric element 300 (the length direction of the pressure generation chamber 12). For example, the opening 101 is formed by, after the formation of the protection film 100 over the entire surface of the fluid channel formation substrate 10, selectively patterning the film.

Since the protection film 100 covers the piezoelectric element 300, it is possible to prevent the piezoelectric element 300 from being damaged due to moisture in the air. Any moisture-resistant substance may be used as the material of the protection film 100. For example, it is preferable to use an inorganic insulating material such as silicon oxide ($SiO_X$), tantalum oxide ($TaO_X$), aluminum oxide ($AlO_X$), or the like. In particular, it is most preferable to use aluminum oxide ($AlO_X$) that is an inorganic amorphous material, for example, alumina ($Al_2O_3$). With the use of aluminum oxide as the material of the protection film 100, even when the thickness of the protection film 100 is comparatively small, for example, 100 nm or so, it is possible to prevent moisture permeation in a high-humidity environment. In addition, since the opening 101 is formed in the protection film 100, it is possible to offer excellent ink-discharging performance without obstructing the deformation operation of the piezoelectric element 300.

With the structure of the piezoelectric element 300 and the protection film 100 explained below, the concentration of stress at the end of the opening 101 of the protection film 100 is reduced. Therefore, an actuator device according to the present embodiment of the invention makes it possible to prevent the piezoelectric element 300 from being damaged.

Figure 3A:
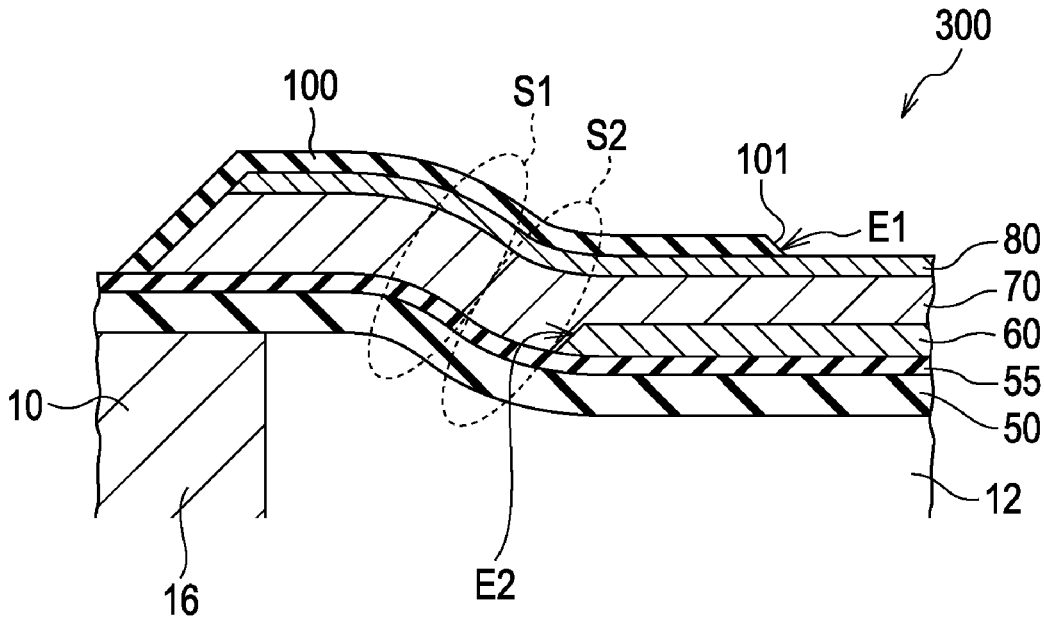
FIG. 3A is a sectional view that schematically illustrates an example of the structure of a recording head according to an exemplary embodiment of the invention.

In the following description, the structure of the piezoelectric element 300 and the protection film 100 is explained with reference to FIG. 3. FIG. 3A is an enlarged sectional view that schematically illustrates an example of the structure of an essential part of an ink-jet recording head according to an exemplary embodiment of the invention during driving operation, which is viewed in the length direction of a pressure generation chamber. As illustrated in FIG. 3A, the piezoelectric substance layer 70 contracts because of the application of a voltage between the first electrode 60 and the second electrode 80 during driving operation. As the piezoelectric substance layer 70 contracts, the piezoelectric element 300 and the vibrating diaphragm get deformed to form a bulge toward the pressure generation chamber 12. When the piezoelectric element 300 and the vibrating diaphragm get deformed, they become curved near the end region of the pressure generation chamber 12 viewed in the length direction of the pressure generation chamber 12, especially near a wall portion (chamber-surrounding wall) 16 of the fluid channel formation substrate 10 viewed in the length direction of the pressure generation chamber 12. Stress acts at a region S1 near the peripheral wall portion 16 surrounding the pressure generation chamber 12. The region S1 is an area at which the center of curvature of the curve of the piezoelectric element 300 and the vibrating diaphragm lies at the pressure-generation-chamber (12) side. The stress acts on the piezoelectric substance layer 70 at the protection-film (100) side in a pulling direction at the region S1. On the other hand, stress acts at a region S2, which is an area at which the center of curvature of the curve of the piezoelectric element 300 and the vibrating diaphragm lies at the piezoelectric-element-holding-portion (31) side, on the piezoelectric substance layer 70 at the protection-film (100) side in a contracting direction.

An end E1 of the opening area 101 formed in the protection film 100 viewed in the length direction of the pressure generation chamber 12 is located at a position relatively close to the center in comparison with the region S1, which is an area at which the center of curvature of the curve of the piezoelectric element 300 and the vibrating diaphragm lies at the pressure-generation-chamber (12) side and which stress acts on the piezoelectric substance layer 70 at the protection-film (100) side in a pulling direction. That is, the end E1 is located at a center side. As explained earlier, a force is applied to the piezoelectric substance layer 70 in a contracting direction during driving operation. If the end E1 of the opening area 101 were located in the area at which stress acts on the piezoelectric substance layer 70 at the protection-film (100) side in a pulling direction, stress would concentrate at the end E1 because of reverse stress that acts at the end E1, which could cause damage to the piezoelectric element 300. The reason why the end E1 is located at a position relatively close to the center is to avoid such damage. In the present embodiment of the invention, the end E1 of the opening area 101 is located at a position relatively close to the center in comparison not only with the region S1, which is an area at which stress acts in a pulling direction, but also with the region S2, which is an area at which stress acts in a contracting direction, over the first electrode 60 (i.e., to overlap the first electrode 60 in a plan view), that is, over the piezoelectric substance activation portion 320. With the above structure, it is possible to prevent stress from being applied intensively to the end E1 and thereby prevent the piezoelectric element 300 from being damaged.

If the end E1 of the opening area 101 were formed over an area between the first electrode 60 and the wall portion 16 of the fluid channel formation substrate 10 (i.e., sidewall portion of the fluid channel formation substrate 10 viewed in the length direction of the piezoelectric substance layer 70) with an aim to increase deformation efficiency, stress would be applied intensively to the end E1 because the end E1 is located inside the region S1. For this reason, there is a risk that the piezoelectric element 300 is damaged due to stress concentration. If the end E1 were formed over the wall portion 16 of the fluid channel formation substrate 10, it would be necessary to increase the size of the piezoelectric element 300 in order to maintain sufficient rigidity, though deformation efficiency increases. The increased size of the piezoelectric element 300 results in an increase in the size of the ink-jet recording head I, which is disadvantageous.

Figure 3B:
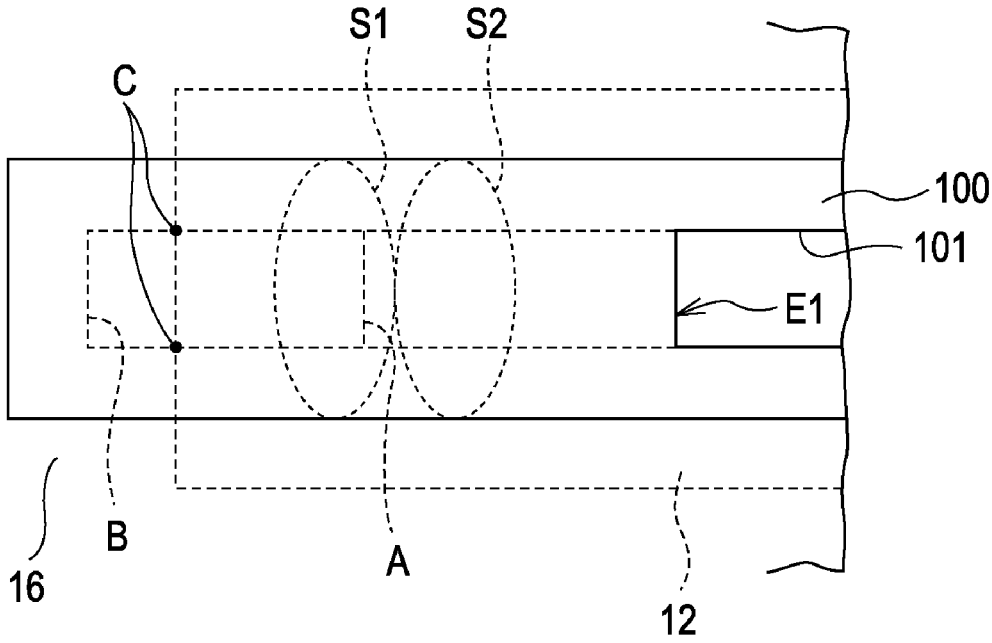
FIG. 3B is a plan view that schematically illustrates an example of an essential part of a recording head according to an exemplary embodiment of the invention.

A further explanation is given below with reference to a plan view of FIG. 3B. If the end E1 of the opening area 101 were formed over an area between the first electrode 60 and the wall portion 16 of the fluid channel formation substrate 10 with an aim to increase deformation efficiency, stress concentration would occur at the end E1 of the opening area 101 because the end E1 is located inside the region S1 (refer to a dotted line A in the drawing). Therefore, there is a risk that the piezoelectric element 300 is damaged due to stress concentration. If the end E1 were formed over the wall portion 16 of the fluid channel formation substrate 10 (refer to a dotted line B in the drawing), the opening area 101 would be formed throughout a region over the wall portion 16 and a region over the pressure generation chamber 12, which are different in terms of rigidity from each other, because the end E1 is formed over the wall portion 16, although deformation efficiency increases. Because of a difference in rigidity therebetween, it is likely that stress concentration will occur at a boundary C between the wall portion 16 and the pressure generation chamber 12, causing damage to the piezoelectric element 300.

That is, in the present embodiment of the invention, since the end E1 is formed outside the region S1, which is an area where stress acts on the piezoelectric substance layer 70 at the protection-film (100) side in a pulling direction due to deformation during driving operation, it is possible to avoid stress concentration at a difference in level that is formed by the end E1. For this reason, it is possible to prevent the piezoelectric element 300 from being damaged. If patterning precision is taken into consideration, it is preferable that a distance between the end E1 of the opening area 101 and an end E2 of the first electrode 60 viewed in the length direction of the pressure generation chamber 12 should be 10 μm or greater.

In addition, an end of the piezoelectric substance activation portion 320 viewed in its length direction, that is, the end E2 of the first electrode 60, is also located at a position relatively close to the center in comparison with the region S1 in order to avoid pulling stress. Note that it is possible to avoid stress concentration in a pulling direction as long as the end E2 of the piezoelectric substance activation portion 320 viewed in its length direction is not located in the region 51. Therefore, for example, it may be formed over the wall portion 16.

In the present embodiment of the invention, as illustrated in FIG. 2A, the protection film 100 continuously covers the plurality of piezoelectric elements 300 (piezoelectric substance activation portions 320). However, the scope of the invention is not limited to such an exemplary structure. For example, the protection film 100 may be formed individually for each piezoelectric element 300.

A lead electrode 90 is provided on the protection film 100. The lead electrode 90 is made of gold (Au) or the like. One end of the lead electrode 90 is connected to the second electrode 80 via another opening 101*a*, which is formed through the protection film 100.

A protection substrate 30 is bonded to, by means of an adhesive 35, the fluid channel formation substrate 10 that has the piezoelectric elements 300 formed thereon. The protection substrate 30 has a piezoelectric-element holding portion 31 at a region facing the piezoelectric elements 300. The piezoelectric-element holding portion 31 has an inner space that is wide enough so as not to obstruct the motion of the piezoelectric elements 300. As long as the space is sufficiently large so as not to hamper the movement of the piezoelectric elements 300, the piezoelectric-element holding portion 31 may be sealed or not sealed.

A reservoir portion 32 is formed in the protection substrate 30 at an area opposite the communicating portion 13. As explained earlier, the reservoir portion 32 is in communication with the communicating portion 13. The reservoir portion 32 and the communicating portion 13 constitute a reservoir 110, which serves as a common ink chamber for each of the pressure generation chambers 12. A through-hole cavity 33 is provided at an area between the piezoelectric-element holding portion 31 of the protection substrate 30 and the reservoir portion 32 thereof. The through-hole cavity 33 is formed through the protection substrate 30 in its thickness direction. A part of the first electrode 60 and the front end of the lead electrode 90 are exposed inside the through-hole cavity 33. The front end of the lead electrode 90 is connected to a driving circuit (explained below) that drives the piezoelectric elements 300 via a connection line.

The driving circuit 200 for driving the piezoelectric elements 300 is mounted on the protection substrate 30. For example, a circuit board and a semiconductor integrated circuit (IC) may be used for the driving circuit 200. The driving circuit 200 is electrically connected to the lead electrode 90 via a connection line 210 that is made up of conductive wires such as bonding wires or the like.

It is preferable that the protection substrate 30 should be made of a material having substantially the same coefficient of thermal expansion as that of the fluid channel formation substrate 10 such as glass, ceramic material, or the like. In the present embodiment of the invention, the protection substrate 30 is made of a silicon single crystal substrate, that is, the same material that constitutes the fluid channel formation substrate 10.

A compliance substrate 40, which is made up of a sealing film 41 and a fixation plate 42, is bonded to the protection substrate 30. The sealing film 41 is made of a flexible material having a low rigidity (for example, a polyphenylene sulfide (PPS) film having a thickness of 6 μm). The sealing film 41 seals one end of the reservoir portion 32. On the other hand, the fixation plate 42 is made of a hard material such as metal (for example, a stainless steel (SUS) having a thickness of 30 μm). Some region of the fixation plate 42 that is opposite to the reservoir constitutes an opening 43, that is, an open space that penetrates through the fixation plate 42 in its thickness direction. As the fixation plate 42 has such a structure, it is the flexible sealing film 41 only that seals one end of the reservoir.

An ink-jet recording head according to the present embodiment of the invention having the configuration described above operates as follows. First of all, ink is fed from an external ink supply unit, which is not shown in the drawing. The inner fluid channel structure from the reservoir 110 to the nozzle orifices 21 is filled with the supplied ink. Thereafter, in accordance with a recording signal sent from the driving circuit 200, voltage is applied between the first electrode 60 and the second electrode 80 that corresponds to each of the pressure generation chambers 12 so as to deflect and deform the elastic membrane 50, the first electrode 60, and the piezoelectric substance layer 70. By this means, the inner pressure of each of the pressure generation chambers 12 is raised to eject ink drops from the nozzle orifice 21.

Other Embodiments

Although an exemplary embodiment of the invention is explained above, needless to say, the scope of the invention is not limited to the foregoing embodiment. For example, though it is explained in the foregoing embodiment of the invention that the protection substrate 30 that has the piezoelectric-element holding portion 31 is provided, since the piezoelectric elements 300 covered by the protection film 100 are protected against damage caused by external environment, the piezoelectric-element holding portion 31 may be formed as a through-hole cavity that is formed through the protection substrate 30 in its thickness direction. Or, the protection substrate 30 may be omitted for the above reason.

Figure 4:
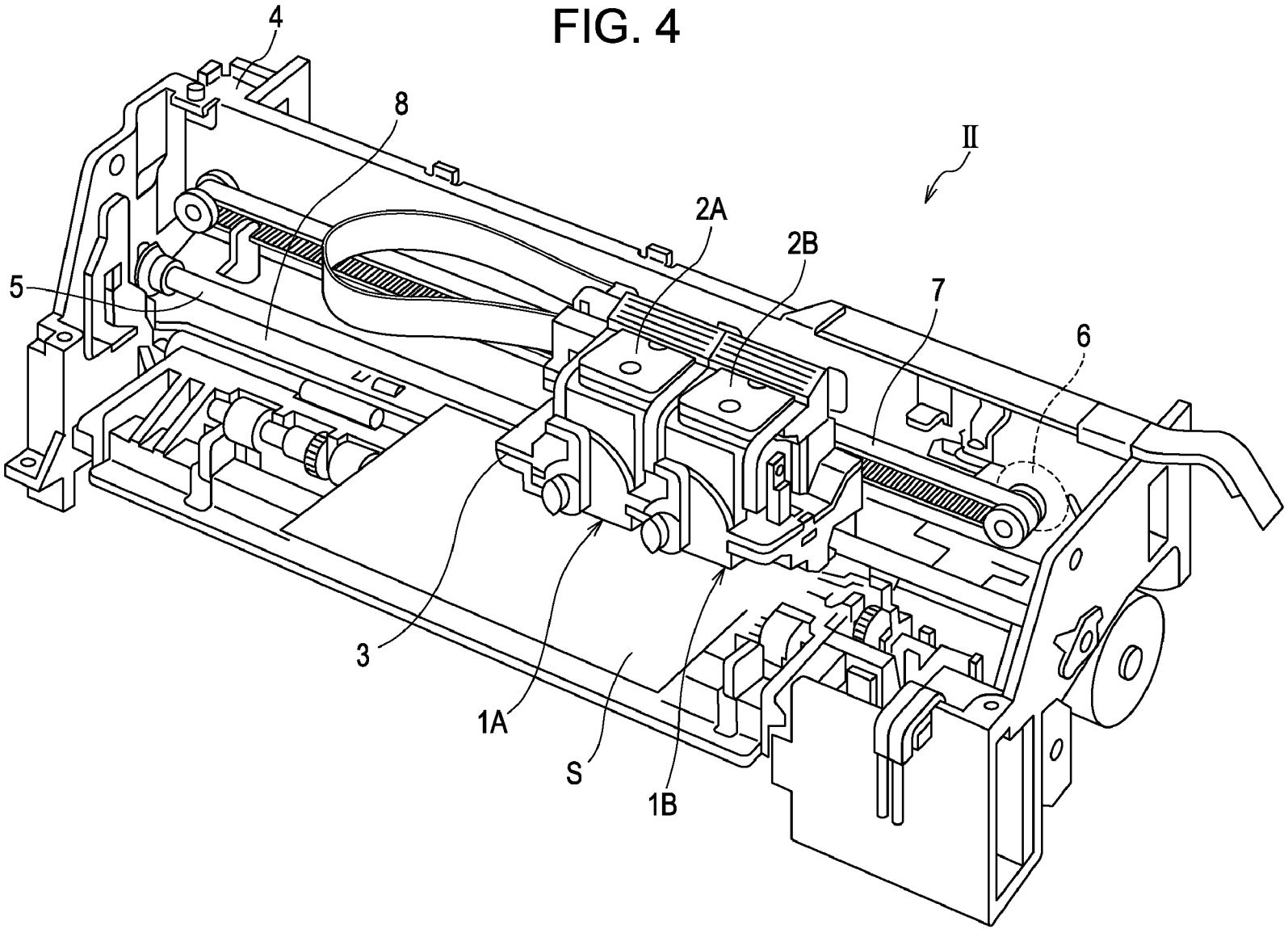
FIG. 4 is a perspective view that schematically illustrates an example of the configuration of a recording apparatus according to an exemplary embodiment of the invention.

The ink-jet recording head I according to an exemplary embodiment of the invention is a part of an ink-jet recording head unit. The ink-jet recording head unit has ink flow channels that are in communication with ink cartridges or the like when the ink cartridges are attached thereto. Such an ink-jet recording head unit is mounted on an ink-jet recording apparatus II. FIG. 4 is a perspective view that schematically illustrates an example of the configuration of an ink-jet recording apparatus according to an exemplary embodiment of the invention.

As illustrated in FIG. 4, ink cartridges 2A and 2B, which are ink supply units, are detachably attached to ink-jet recording head units 1A and 1B, respectively. Each of the recording head units 1A and 1B is equipped with the ink-jet recording head I. The recording head unit 1A, 1B is mounted on a carriage 3. The carriage 3 is configured to move freely in the axial direction of a carriage shaft 5, which is fixed to an apparatus body chassis 4. The recording head units 1A and 1B are configured to discharge, for example, black ink compound and color ink compound, respectively.

As the driving power of a driving motor 6 is transmitted to the carriage 3 through the rotation of a plurality of gears and a timing belt 7, the carriage 3 on which the recording head units 1A and 1B are mounted travels along the carriage shaft 5. Note that the plurality of gears is not illustrated in the drawing. On the other hand, a platen 8 is provided in the apparatus body chassis 4 along the carriage shaft 5. A recording sheet S, which is a recording target medium such as a sheet of paper that is supplied by a paper feed roller that is not shown in the drawing, is transported over the platen 8.

In the foregoing explanation of the first embodiment of the invention, an ink-jet recording head is taken as an example of a liquid ejecting head. Notwithstanding the foregoing, the invention is directed to various kinds of liquid ejecting heads; and therefore, needless to say, the invention is also applicable to a variety of liquid ejecting heads that eject other liquid besides an ink-jet recording head. Liquid ejecting heads to which the invention is applicable encompass a wide variety of heads; specifically, they include without any limitation thereto: a variety of recording heads that are used in an image recording apparatus such as a printer or the like, a color material ejection head that is used in the production of color filters for a liquid crystal display device or the like, an electrode material ejection head that is used for the electrode formation of an organic EL display device or a surface/plane emission display device (FED) and the like, and a living organic material ejection head that is used for production of biochips. The invention can be applied not only to an actuator device that is mounted in a liquid ejecting head as a pressure generation means but also to various actuator devices mounted in various equipment. For example, besides an ejecting head explained above, an actuator device according to an aspect of the invention can be used for a sensor and the like.

What is claimed is:

1. A liquid ejecting head comprising:

a flow passage substrate that has a pressure generation chamber, the pressure generation chamber formed in the flow passage substrate being in communication with a nozzle opening through which liquid is ejected;

a piezoelectric element that includes a first electrode, a piezoelectric substance layer, and a second electrode, the piezoelectric element being provided over one surface of the flow passage substrate, the piezoelectric element getting deformed to form a convex toward the pressure generation chamber when the piezoelectric element is driven; and a protection film that covers the piezoelectric element, the protection film having an opening through which an upper surface of the second electrode is exposed, the protection film being made of an inorganic insulating material, wherein an end of the opening formed in the protection film when viewed in a direction of the length of the pressure generation chamber is located at a position relatively close to a center of the pressure generation chamber in comparison with an area at which the center of curvature of a curve of the piezoelectric element that forms near a peripheral wall around the pressure generation chamber during deformation operation lies at a pressure-generation-chamber side, wherein the end of the opening formed in the protection film when viewed in the direction of the length of the pressure generation chamber is located over the first electrode, and wherein a distance between the end of the opening formed in the protection film when viewed in the direction of the length of the pressure generation chamber and the end of the first electrode viewed in the direction of the length of the pressure generation chamber is 10 μm or greater.

2. The liquid ejecting head according to claim 1, wherein the first electrode is provided over the one surface of the flow passage substrate with a vibrating diaphragm being sandwiched between the first electrode and the flow passage substrate; an end of the first electrode when viewed in the direction of the length of the pressure generation chamber is located at a position relatively close to the center of the pressure generation chamber in comparison with an area at which the center of curvature of the curve of the vibrating diaphragm and the piezoelectric element that forms near the peripheral wall around the pressure generation chamber during deformation operation lies at the pressure-generation-chamber side.

3. A liquid ejecting apparatus that is provided with the liquid ejecting head according to claim 1.

4. An actuator device comprising:

a piezoelectric element that includes a first electrode, a piezoelectric substance layer, and a second electrode, the piezoelectric element being provided at an area facing a concave portion of a substrate, the piezoelectric element getting deformed to form a convex toward a pressure generation chamber when the piezoelectric element is driven; and a protection film that covers the piezoelectric element, the protection film having an opening through which a surface of the second electrode is exposed, the protection film being made of an inorganic insulating material, wherein an end of the opening formed in the protection film when viewed in a direction of the length of the pressure generation chamber is located at a position relatively close to a center of the pressure generation chamber in comparison with an area at which the center of curvature of a curve of the piezoelectric element that forms near a wall around the pressure generation chamber during deformation operation lies at a pressure-generation-chamber side, wherein the end of the opening formed in the protection film when viewed in the direction of the length of the pressure generation chamber is located over the first electrode, and wherein a distance between the end of the opening formed in the protection film when viewed in the direction of the length of the pressure generation chamber and the end of the first electrode viewed in the direction of the length of the pressure generation chamber is 10 μm or greater.

* * * * *